US005273220A

United States Patent [19]

Whitney

[11] Patent Number: 5,273,220

[45] Date of Patent: Dec. 28, 1993

[54] APPARATUS AND METHODS FOR COMMINUTING

[75] Inventor: John P. Whitney, Benton, Ark.

[73] Assignee: Rineco Chemical Industries, Benton, Ark.

[21] Appl. No.: 788,183

[22] Filed: Nov. 5, 1991

[51] Int. Cl.[5] ..... B02C 7/02

[52] U.S. Cl. ..... 241/85; 241/46.15; 241/261.2

[58] Field of Search ..... 241/21, 46.15, 85, 87, 241/89.4, 92, 257.1, 258, 278.1, 261.2

[56] References Cited

U.S. PATENT DOCUMENTS

| | | | |
|---|---|---|---|
| 3,298,411 | 1/1967 | Rosett | 241/84.1 |
| 4,015,784 | 4/1977 | Hughes | 241/257.1 X |
| 4,066,215 | 1/1978 | Pujol | 241/46.11 |
| 4,117,981 | 10/1978 | Engels | 241/46.15 |
| 4,129,261 | 12/1978 | Engels et al. | 241/46.11 |
| 4,243,180 | 1/1981 | Bonnel | 241/79.2 |
| 4,513,917 | 4/1985 | Szkaradek | 241/46.11 |
| 4,819,881 | 4/1989 | Sepke | 241/261.2 X |

FOREIGN PATENT DOCUMENTS

| | | | |
|---|---|---|---|
| 39536 | 6/1887 | Fed. Rep. of Germany | 241/89.4 |

OTHER PUBLICATIONS

Translation of:German Patent No. 39536 published Jun. 1887.

*Primary Examiner*—Eugenia Jones
*Assistant Examiner*—Raymond D. Woods
*Attorney, Agent, or Firm*—Oliff & Berridge

[57] ABSTRACT

Comminuting apparatus comprising a housing, a rotatable spindle, first and second members each having a hole through which the spindle passes, the first and second members each also having at least one additional hole extending therethrough, at least a portion of at least one of the first and second members fitting snugly against the housing. Comminuting apparatus comprising a rotatable spindle, first, second and third members each having a hole through which the spindle passes, the first, second and third members each also having at least one additional hole formed therethrough, the first member abutting the second member, the second member abutting the third member. Comminuting apparatus comprising a rotatable spindle, a first member having a hole through which the spindle passes, the first member also having at least one second hole extending therethrough, and a spacer splined to the spindle, the first hole of the first member being rotatably mounted on the spacer. Methods for comminuting materials including solid material and/or liquid material comprising passing the material through comminuting apparatus.

25 Claims, 3 Drawing Sheets

APPARATUS AND METHODS FOR COMMINUTING

BACKGROUND OF THE INVENTION

1. Field of the Invention

The present invention relates to apparatus for comminuting, and to methods of comminuting, more particularly, to comminuting materials comprising solid material and/or liquid material.

1. Description of the Prior Art

There exist many devices and many methods for comminuting materials.

U.S. Pat. No. 3,298,411 discloses a comminuting apparatus. Referring to FIGS. 4 and 5, the apparatus includes a plurality of disks 34, 35, 36 and 37 perforated with circular holes, the disks fitting snugly against and in slidable engagement with the inside wall of a receptacle 27. The disks are loosely disposed in a relatively horizontal position. To commence comminuting, a drill press 10 is started which causes a pad 20 to rotate, and as an operator lever 11 is moved, the pad 20 comes into contact with the uppermost disk 34 and causes this disk to rotate.

U.S. Pat. No. 4,066,215 discloses a disk for a grinder. Referring to FIG. 6, disks 1 having apertures 3 are mounted on their central orifices 5 (see FIG. 1) on a rotatable agitating shaft 6.

U.S. Pat. No. 4,117,981 discloses a stirring mill which includes a separating device. Referring to FIG. 2, the separating device has a plurality of annular disks each having apertures 40 and being disposed on a mixing shaft 7, annular disks 23 and 24 being non-rotatably connected with the moving shaft 7. Annular disks 26 and 27 are radially and axially movable with respect to the mixing shaft 7. The disks 23 and 24 are made axially immovable by means of spacing rings 31, 32, 33 and spacing bushings 34 and 35.

U.S. Pat. No. 4,513,917 discloses sand mill rotor disks. Referring to FIG. 3, a rotor 14 includes a shaft 16 and a plurality of axially spaced rotor disks 18, the rotor disks each having ports 40 and including a tubular hub 28 secured to the shaft 16 by a pin 30 which extends diametrically through a hole 31.

Such apparatus and methods all suffer from various drawbacks, including insufficient throughput capability, insufficient uniformity of products, insufficient reliability, insufficient durability and high initial and/or maintenance cost, among others.

SUMMARY OF THE INVENTION

It is an object of the present invention to provide apparatus and methods for comminuting materials which provides superior throughput, uniformity of products, reliability and durability at a feasible initial and maintenance cost.

In accordance with the present invention, there is provided comminuting apparatus comprising:

a housing;

a rotatable spindle within the housing;

a first member having a first surface and a second surface, the first member having a first hole extending from the first surface to the second surface, the spindle passing through the first hole, the first member also having at least one second hole extending from the first surface to the second surface;

a second member having a third surface and a fourth surface, the second member having a third hole extending from the third surface to the fourth surface, the spindle passing through the third hole, the second member also having at least one fourth hole extending from the third surface to the fourth surface;

at least a portion of at least one of the first and second members fitting snugly against the housing.

There is also provided a comminuting apparatus comprising:

a rotatable spindle;

a first member having a first surface and a second surface, the first member having a first hole extending from the first surface to the second surface, the spindle passing through the first hole, the first member also having at least one second hole extending from the first surface to the second surface;

a second member having a third surface and a fourth surface, the second member having a third hole extending from the third surface to the fourth surface, the spindle passing through the third hole, the second member also having at least one fourth hole extending from the third surface to the fourth surface;

a third member having a fifth surface and a sixth surface, the third member having a fifth hole extending from the fifth surface to the sixth surface, the spindle passing through the fifth hole, the third member also having at least one sixth hole extending from the fifth surface to the sixth surface;

the third surface of the second member abutting the second surface of the first member, the fifth surface of the third member abutting the fourth surface of the second member.

In addition, there is provided a comminuting apparatus comprising:

a rotatable spindle;

a first member having a first surface and a second surface, the first member having a first hole extending from the first surface to the second surface, the spindle passing through the first hole, the first member also having at least one second hole extending from the first surface to the second surface;

a spacer splined to the spindle, the spacer having an aperture through which the spindle passes, the first hole of the first member being rotatably mounted on the spacer.

The present invention also provides methods of comminuting, comprising passing materials which comprise a solid material and/or a liquid material through a comminuting apparatus as disclosed herein.

The present invention provides the above-mentioned advantages. Included in the advantages of the present invention are the facts that (1) when, e.g., a metal bolt inadvertently enters the comminuting apparatus, the only effect is that the apparatus locks, and excessive damage is avoided, and (2) when necessary, the members can be removed and surface-grinded to maintain the comminuting effectiveness of the apparatus.

The invention may be more fully understood with reference to the accompanying drawings and the following description of the embodiments shown in those drawings. The invention is not limited to the exemplary embodiments and should be recognized as contemplating all modifications within the skill of an ordinary artisan.

DETAILED DESCRIPTION OF THE PREFERRED EMBODIMENTS

In accordance with one aspect of the present invention, there is provided an apparatus for comminuting. The term "comminuting" is used herein to encompass any physical treatment which can be accomplished by passing material through the apparatus, for example, breaking, cutting, grinding, pressing, tearing or pulverizing solids, homogenizing or blending liquids, etc.

Figure 1:
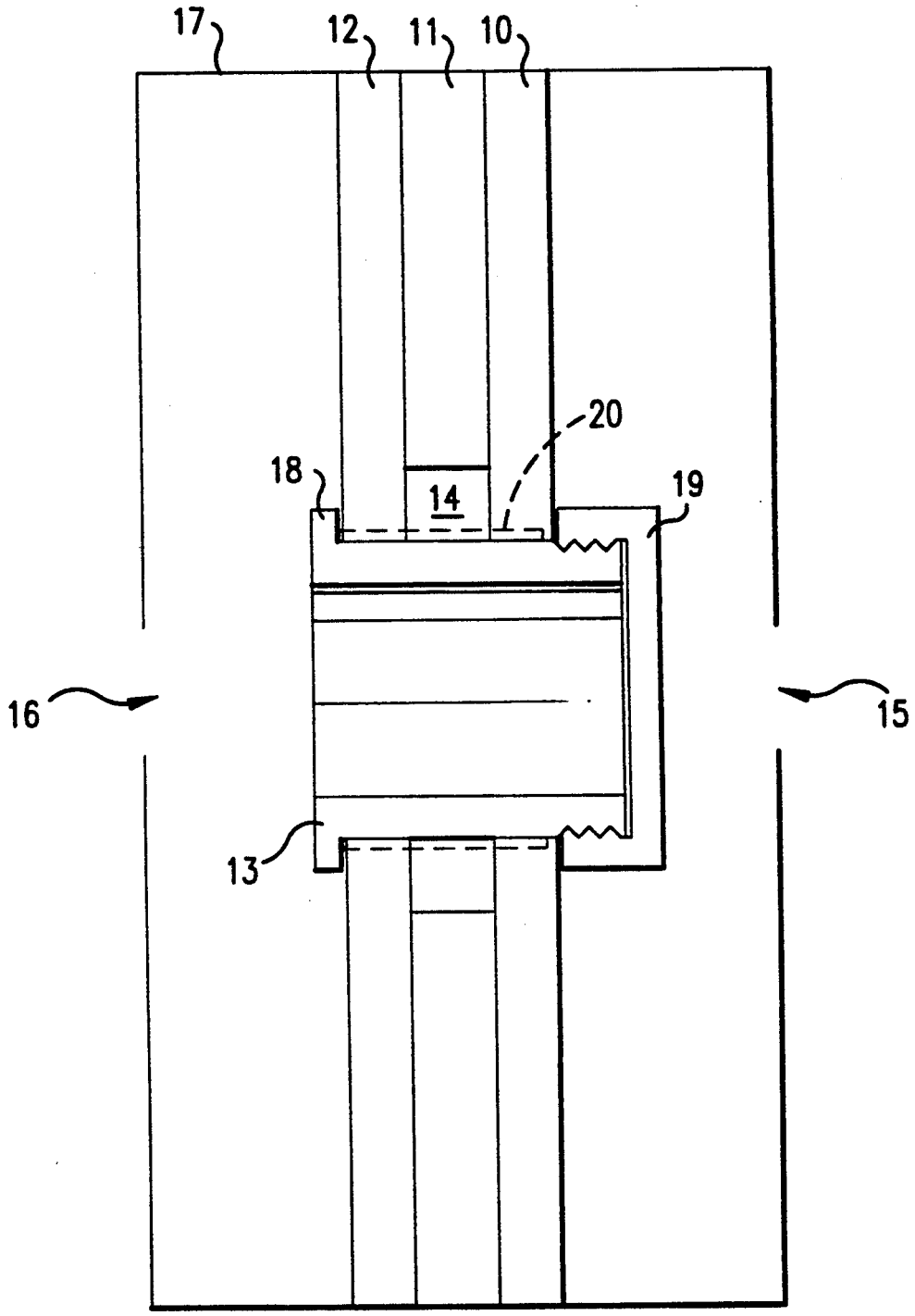
FIG. 1 is a cross-sectional view of one embodiment of a comminuting apparatus in accordance with the present invention.
Figure 2:
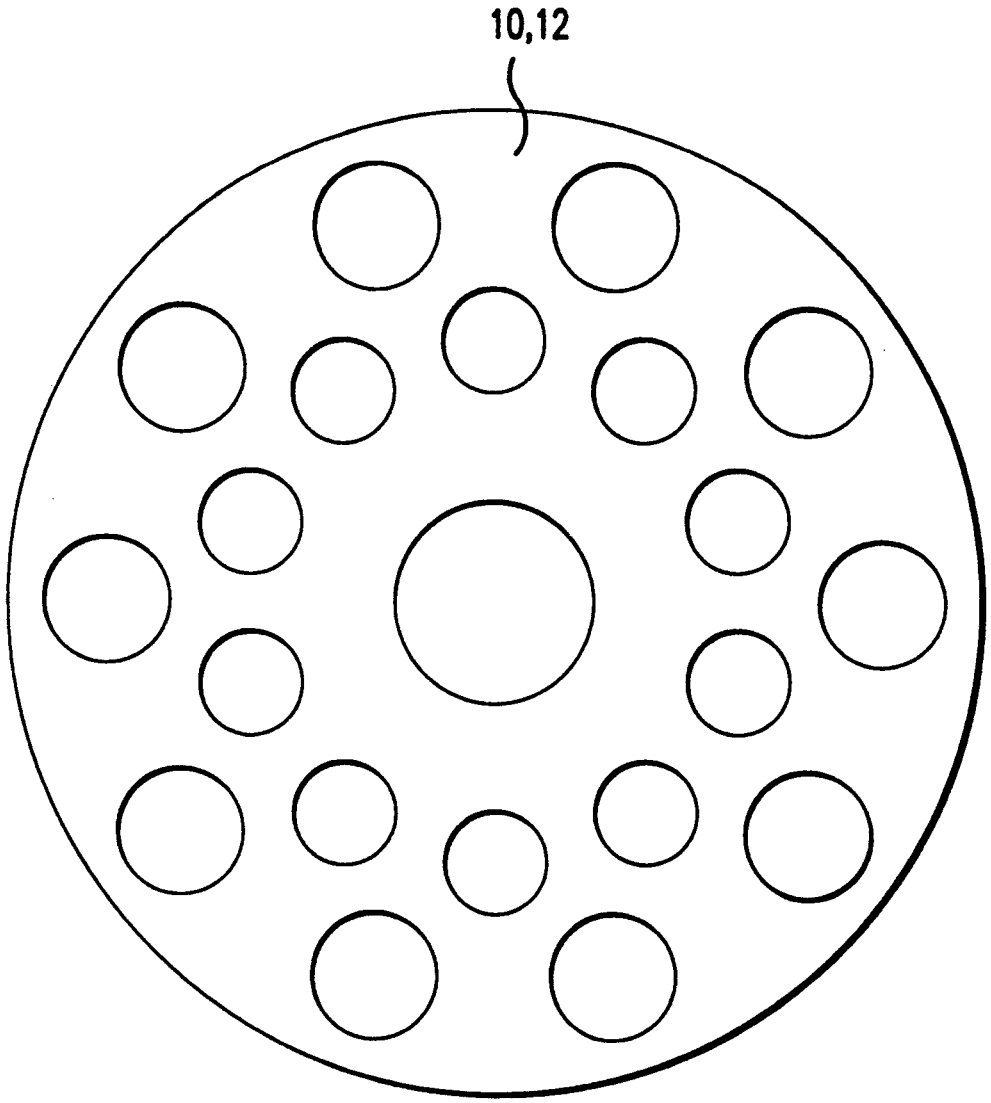
FIGS. 2 and 3 are front views of discs in the comminuting apparatus depicted in FIG. 1.

FIG. 1 depicts one embodiment of a comminuting apparatus in accordance with the present invention. The comminuting apparatus includes first and third discs 10, 12 splined to a spindle 13 via spline 20, each of the discs 10, 12 having holes formed therethrough (as shown in FIG. 2). The present invention contemplates embodiments which have more or fewer discs, e.g., embodiments having 5 and 7 discs. Positioned between the first and third discs 10, 12 is a second disc 11 rotatably mounted on a spacer 14 which is splined to the spindle 13 via spline 20, the second disc 11 also having holes formed therethrough (see FIG. 3). In the embodiment shown in FIG. 1, the discs 10, 11, 12 and the spacer 14 are secured in place between a shoulder 18 on the spindle 13 and a cap 19 which is screw-threaded onto the spindle 13. The discs 10, 11, 12 abut one another, such that in operation, there is only a thin film of the material being comminuted between the discs. In operation, the spindle 13 is rotated, together with the first and third discs 10, 12 and the spacer 14, preferably at a rate of from about 80 to about 1750 revolutions per minute. The material being comminuted is fed by any suitable means, e.g., a pump, into an inlet 15 adjacent to the first disc 10, passes through the holes in the first disc 10, then through the holes in the second disc 11, and finally through the holes in the third disc 12, after which it exits through an outlet 16.

The first, second and third discs 10, 11, 12 are positioned within a cylindrical housing 17 such that the peripheral surfaces of the discs 10, 11, 12 fit snugly within the housing 17. For example, the clearance between the peripheral surfaces of the discs and the housing may preferably be about 50 or fewer thousandths of an inch. The clearance is preferably smaller than the diameter of the largest particle size desired in the effluent from the comminuting apparatus. To reduce the clearance, it is possible to line the housing with any suitable material, e.g., ultra high molecular weight polyethylene, available from Hoescht Celanese.

The discs 10, 11, 12 are formed of a material of suitable mechanical properties such that they can withstand the conditions to which they are subjected during comminuting. Such conditions depend, for example, on the nature, flow rate and pressure of the material being comminuted, the rate of rotation of the discs and the sizes of the discs. For example, suitable materials out of which the discs 10, 11, 12 can be constructed include steel and other durable metals and alloys, ceramics and polymer materials. Preferred materials include "work-harder" materials, i.e., materials which become harder as the apparatus is used. Any suitable coating may be applied to the surfaces of the discs 10, 11, 12, the spindle 13 or the spacer 14 to provide increased durability. For example, high molecular weight polymers, e.g., ultra high molecular weight polyethylene (available from Hoescht Celanese), may be used as suitable coatings.

Figure 3:
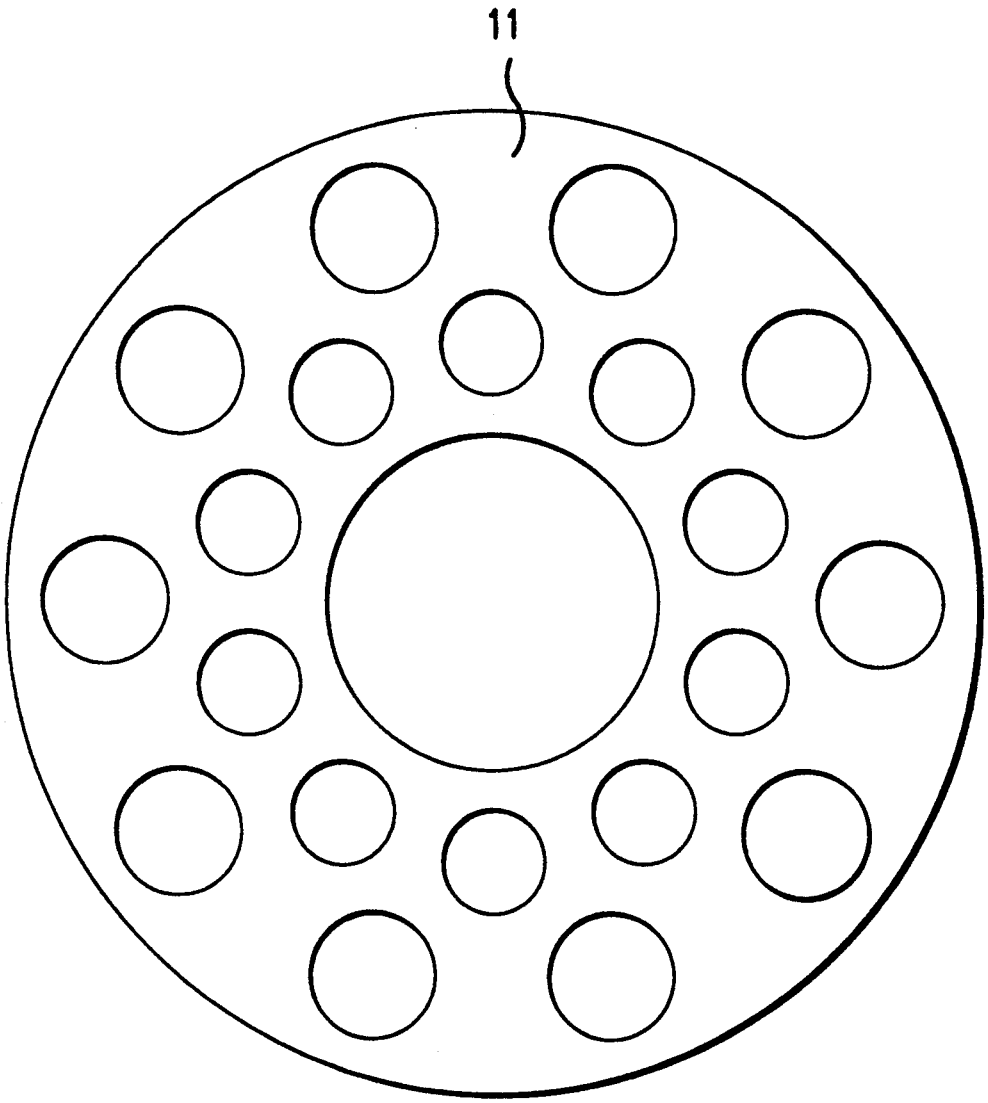

Referring to FIGS. 2 and 3, the discs 10, 11, 12 each have a plurality of holes (in addition to the one through which the spindle passes) formed through the thickness of the disc. The holes may be of any suitable shape, and circular holes are preferred. A disc which is upstream relative to a more downstream disc preferably has holes which are larger than the holes in the more downstream disc. In the case of circular holes, the diameter of the holes is preferably in the range of from about ¼ inch or about 3/16 inch to about 2¼ inch. The walls of the holes preferably are straight (as shown in FIGS. 2 and 3) although it may be suitable to provide holes which have a slanted shape, curved shape or any other shape. For example, for some applications, it may be desirable to provide holes which have an acute angle edge at the front surface of a disc (i.e., the surface facing upstream) at the back edge of the hole relative to the direction of rotation of the disc.

The material being comminuted can generally be any material, for example, a composition which comprises solid material, one which comprises liquid, one which comprises solid and liquid, or any of the above together with one or more gas. Suitable flow rates through the comminuting apparatus vary widely depending on the nature of the material being comminuted, the pressure within the comminuting apparatus, the relative size of the comminuting apparatus and the rate of rotation of the spindle of the comminuting apparatus.

The sizes of the elements in the comminuting apparatus according to this invention may vary widely depending on the application for which the apparatus is used. For example, for larger flow rates of materials containing large particles, the elements should be relatively larger. The relationship between the sizes of the various elements can also vary widely. The diameter of the discs (which is usually the same for all of the discs) is preferably from about 6 inches to about 17 inches, which preferably is from about 3 to about 5.5 times the diameter of the spindle. The diameter of the spacer is preferably from about 1.25 to about 2 times the diameter of the spindle. The thickness of the discs (which may or may not be the same for all of the discs) is preferably from about ⅛ inch to about ¾ inch.

The comminuting apparatus according to the present invention can be used to treat a variety of materials. For example, the comminuting apparatus according to this invention can be used to comminute waste. The term "waste" is used herein to mean by-products of a process, such by-products being of a nature that the operator of the process desires to dispose of them. One particular type of waste which can be treated is hazardous waste. The phrase "hazardous waste" is defined herein in accordance with prevailing governmental codes. Under current prevailing codes, materials such as sludges from sewage treatment mills, food processing waste materials, pulp and paper industry waste material and rubber wastes are all non-hazardous waste materials. Refinery oil/water separator sludges may or may not contain hazardous waste.

Although the apparatus and methods in accordance with the present invention have been described in connection with preferred embodiments, it will be appreciated by those skilled in this art that additions, modifications, substitutions and deletions not specifically described may be made without departing from the spirit and scope of this invention as defined in the appended claims.

What is claimed is:

1. An apparatus for comminuting material comprising:

a housing having an inlet for material to be comminuted and an outlet for comminuted material;

a rotatable spindle within said housing;

a first member supported on said spindle and having a first surface and a second surface, said first member having a first hole extending from said first surface to said second surface, said spindle passing through said first hole, said first member also having at least one second hole extending from said first surface to said second surface;

a second member supported on said spindle and having a third surface and a fourth surface and a third hole extending from said third surface to said fourth surface, said spindle passing through said third hole, said second member also having at least one fourth hole extending from said third surface to said fourth surface;

at least a portion of at least one of said first and second members being disposed in relative sealing relation with said housing so as to prevent material being comminuted from passing between a periphery of the members and the housing, the comminuted material having a partical size larger than a predetermined limit, said second member being disposed immediately adjacent said first member, said first and second members being rotatable in response to rotation of said spindle, and said first and second members being disposed in a flow path between said inlet and said outlet of said housing.

2. A comminuting apparatus as recited in claim 1, further comprising a third member supported on said spindle and having a fifth surface and a sixth surface and a fifth hole extending from said fifth surface to said sixth surface, said spindle passing through said fifth hole, said third member also having at least one sixth hole extending from said fifth surface to said sixth surface;

said third surface of said second member being disposed proximate to said second surface of said first member in substantial abutting relationship, said fifth surface of said third member being disposed proximate to said fourth surface of said second member in substantial abutting relationship, and said third member being rotatable in response to rotation of said spindle.

3. A comminuting apparatus as recited in claim 2, wherein said members are disposed relative to each other such that a film of the material being comminuted forms between them.

4. A comminuting apparatus as recited in claim 2, wherein said second member is rotatable relative to said first and third members.

5. A comminuting apparatus as recited in claim 1, wherein said predetermined limit does not exceed 50/1000 of an inch.

6. A comminuting apparatus as recited in claim 1, wherein said first member is fixedly supported on said spindle so as to rotate with said spindle and said second member is rotatably supported on said spindle so as to be rotatable relative to said spindle.

7. A comminuting apparatus as recited in claim 6, further comprising a spacer splined to said spindle, said space having an aperture through which said spindle passes, said first member being splined to said spindle, said spacer passing through said third hole of said second member such that said second member is rotatably mounted on said spacer.

8. A comminuting apparatus as recited in claim 2, wherein said first and third members are fixedly supported on said spindle so as to rotate with said spindle and said second member is rotatably supported on said spindle so as to be rotatable relative to said spindle.

9. A comminuting apparatus as recited in claim 8, further comprising a spacer splined to said spindle, said spacer having an aperture through which said spindle passes, said first member and said third member both being splined to said spindle, said spacer passing through said third hole of said second member such that said second member is rotatably mounted on said spacer.

10. An apparatus for comminuting material comprising:

a housing;

a rotatable spindle within said housing;

a first member supported on said spindle and having a first surface and a second surface, said first member having a first hole extending from said first surface to said second surface, said spindle passing through said first hole, said first member also having at least one second hole extending from said first surface to said second surface;

a second member supported on said spindle in operative comminuting cooperation with said first member and having a third surface and a fourth surface and a third hole extending from said third surface to said fourth surface, said spindle passing through said third hole, said second member also having at least one fourth hole extending from said third surface to said fourth surface;

at least a portion of at least one of said first and second members being disposed in relative sealing relation with said housing so as to prevent material being comminuted from passing between a periphery of the members and the housing, the comminuted material having a partical size larger than a predetermined limit, said first and second members being rotatable in response to rotation of said spindle.

11. A comminuting apparatus as recited in claim 10, further comprising a third member supported on said spindle and having a fifth surface and a sixth surface and a fifth hole extending from said fifth surface to said sixth surface, said spindle passing through said fifth hole, said third member also having at least one sixth hole extending from said fifth surface to said sixth surface;

said third surface of said second member being disposed proximate to said second surface of said first member in substantial abutting relationship, said fifth surface of said third member being disposed proximate to said fourth surface of said second member in substantial abutting relationship, and said third member being rotatable in response to rotation of said spindle.

12. A comminuting apparatus as recited in claim 11, wherein said first and third members are fixedly supported on said spindle so as to rotate with said spindle and said second member is rotatably supported on said spindle so as to be rotatable relative to said spindle.

13. A comminuting apparatus as recited in claim 12, further comprising a spacer splined to said spindle, said spacer having an aperture through which said spindle passes, said first member and said third member both being splined to said spindle, said spacer passing through said third hole of said second member such that said second member is rotatably mounted on said spacer.

14. A comminuting apparatus as recited in claim 11, wherein said members are disposed relative to each other such that a file of the material being comminuted forms between them.

15. A comminuting apparatus as recited in claim 11, wherein said second member is rotatable relative to said first and third members.

16. A comminuting apparatus as recited in claim 10, wherein said first member is fixedly supported on said spindle so as to rotate with said spindle and said second member is rotatably supported on said spindle so as to be rotatable relative to said spindle.

17. A comminuting apparatus as recited on claim 16, further comprising a spacer splined to said spindle, said spacer having an aperture through which said spindle passes, said first member being splined to said spindle, said spacer passing through said third hole of said second member such that said second member is rotatably mounted on said spacer.

18. A comminuting apparatus as recited in claim 10, wherein said predetermined limit doe not exceed 50/1000 of an inch.

19. A comminuting apparatus as recited in claim 10, wherein said second member is disposed proximate to said first member in substantial abutting relationship.

20. An apparatus for comminuting material comprising:

a housing;

a rotatable spindle within said housing;

a first member supported on said spindle and having a first surface and a second surface, said first member having a first hole extending from said first surface to said second surface, said spindle passing through said first hole, said first member also having at least one second hole extending from said first surface to said second surface;

a second member supported on said spindle and having a third surface and a fourth surface and a third hole extending from said third surface to said fourth surface, said spindle passing through said third hole, said second member also having at least one fourth hole extending from said third surface to said fourth surface;

a third member supported on said spindle and having a fifth surface and a sixth surface and a fifth hole extending from said fifth surface to said sixth surface, said spindle passing through said fifth hole, said third member also having at least one sixth hole extending from said fifth surface to said sixth surface;

at least a portion of at least one of said first and second members being disposed in relative sealing relation with said housing so as to prevent material being comminuted from passing between a periphery of the members and the housing, the comminuted material having a partical size larger than a predetermined limit, said first, second and third members being rotatable in response to rotation of said spindle, said third surface of said second member being disposed proximate to said second surface of said first member in substantial abutting relationship, and said fifth surface of said third member being disposed proximate to said fourth surface of said second member in substantial abutting relationship.

21. A comminuting apparatus as recited in claim 20, wherein said first and third members are fixedly supported on said spindle so as to rotate with said spindle and said second member is rotatably supported on said spindle so as to be rotatable relative to said spindle.

22. A comminuting apparatus as recited in claim 21, further comprising a spacer splined to said spindle, said spacer having an aperture through which said spindle passes, said first member and said third member both being splined to said spindle, said spacer passing through said third hole of said second member such that said second member is rotatably mounted on said spacer.

23. A comminuting apparatus as recited in claim 20, wherein said members are disposed relative to each other such that a film of the material being comminuted forms between them.

24. A comminuting apparatus as recited in claim 20, wherein said second member is rotatable relative to said first and third members.

25. A comminuting apparatus as recited in claim 20, wherein said predetermined limit does not exceed 50/100 of an inch.

* * * * *